US005758626A

United States Patent [19]

Maley

[11] Patent Number: 5,758,626

[45] Date of Patent: Jun. 2, 1998

[54] MAGNETICALLY ADJUSTABLE VALVE ADAPTED FOR A FUEL INJECTOR

[75] Inventor: Dale C. Maley, Watkinsville, Ga.

[73] Assignee: Caterpillar Inc., Peoria, Ill.

[21] Appl. No.: 539,570

[22] Filed: Oct. 5, 1995

[51] Int. Cl.[6] ..... F02M 37/04

[52] U.S. Cl. ..... 123/506; 123/458; 251/129.18

[58] Field of Search ..... 123/472, 458, 123/506; 335/237, 230; 251/129.18, 129.16; 239/585

[56] References Cited

U.S. PATENT DOCUMENTS

| | | | |
|---|---|---|---|
| 2,144,862 | 1/1939 | Truxell, Jr. | 299/107.2 |
| 2,434,586 | 1/1948 | Reynolds | 31/58 |
| 2,512,557 | 6/1950 | Weldy | 299/107.6 |
| 2,535,937 | 12/1950 | LeBozec et al. | 299/107.6 |
| 2,552,445 | 5/1951 | Nielsen | 299/131 |
| 2,597,952 | 5/1952 | Rosenlund | 137/139 |
| 2,621,011 | 12/1952 | Smith | 251/27 |
| 2,672,827 | 3/1954 | McGowen, Jr. | 103/232 |
| 2,727,498 | 12/1955 | Reiners | 123/32 |
| 2,749,181 | 6/1956 | Maxwell et al. | 299/107.6 |
| 2,916,048 | 12/1959 | Gunkel | 137/544 |
| 3,035,780 | 5/1962 | Peras | 239/453 |
| 3,057,560 | 10/1962 | Campbell | 239/464 |
| 3,071,714 | 1/1963 | Hadekel | 317/172 |
| 3,410,519 | 11/1968 | Evans | 251/141 |
| 3,570,806 | 3/1971 | Sturman | 251/129 |
| 3,570,807 | 3/1971 | Sturman | 251/65 |
| 3,570,833 | 3/1971 | Sturman et al. | 267/171 |
| 3,585,547 | 6/1971 | Sturman | 335/227 |
| 3,604,959 | 9/1971 | Sturman | 310/12 |
| 3,675,853 | 7/1972 | Lapera | 239/464 |
| 3,683,239 | 8/1972 | Sturman | 317/150 |
| 3,743,898 | 7/1973 | Sturman | 317/154 |
| 3,753,547 | 8/1973 | Topham | 251/120 |
| 3,814,376 | 6/1974 | Reinicke | 251/65 |
| 3,821,967 | 7/1974 | Sturman et al. | 137/624.15 |
| 3,835,829 | 9/1974 | Linke | 123/139 |
| 3,858,135 | 12/1974 | Gray | 335/266 |
| 3,989,066 | 11/1976 | Sturman et al. | 137/624.2 |
| 4,087,736 | 5/1978 | Mori et al. | 322/28 |
| 4,087,773 | 5/1978 | Jencks et al. | 325/243 |
| 4,107,546 | 8/1978 | Sturman et al. | 307/141 |
| 4,108,419 | 8/1978 | Sturman et al. | 251/30 |
| 4,114,647 | 9/1978 | Sturman et al. | 137/624.2 |
| 4,114,648 | 9/1978 | Nakajima et al. | 137/625.5 |
| 4,120,456 | 10/1978 | Kimura et al. | 239/464 |
| 4,152,676 | 5/1979 | Morgenthaler | 333/24.1 |

(List continued on next page.)

FOREIGN PATENT DOCUMENTS

| | | |
|---|---|---|
| 0 246 373 | 11/1987 | European Pat. Off. . |
| 0 425 236 | 5/1991 | European Pat. Off. . |
| 981-664A | 12/1982 | U.S.S.R. . |
| 90/04099 | 4/1990 | WIPO . |
| 92/02726 | 2/1992 | WIPO . |
| 92/03650 | 3/1992 | WIPO . |
| 93/12337 | 6/1993 | WIPO . |

OTHER PUBLICATIONS

Electromagnetic Devices by Herbert C. Roters.

Machine Design, "Breakthrough In Digital Valves", dated Feb. 21, 1994, pp. 37–42.

SAE Technical Paper 891001–Electronic Unit Injectors, Frankl, Barker & Timms, Apr. 11–13, 1989.

*Primary Examiner*—Carl S. Miller

*Attorney, Agent, or Firm*—Mark D. Becker; J. W. Keen

[57] ABSTRACT

A solenoid actuator, adapted for use in an electronic control valve for a fuel injector, having an electrically-energizable electromagnetic device, such as a winding, a pole member associated with the electrically energizable winding, and an armature movable with respect to the pole member. The armature occupies a first position relative to the pole member when the winding is not electrically energized and a second position relative to the pole member when the winding is electrically energized. The actuator has an adjustment screw which is movable with respect to the pole member to form an air gap of variable width internal to the pole member to change the magnetic characteristics of the solenoid actuator, and thus the response of the actuator.

16 Claims, 2 Drawing Sheets

U.S. PATENT DOCUMENTS

| | | | |
|---|---|---|---|
| 4,189,816 | 2/1980 | Chalansonnet | 29/148.4 |
| 4,192,466 | 3/1980 | Tanasawa et al. | 239/464 |
| 4,231,525 | 11/1980 | Palma | 239/585 |
| 4,248,270 | 2/1981 | Ostrowski | 138/45 |
| 4,266,727 | 5/1981 | Happel | 239/409 |
| 4,273,291 | 6/1981 | Muller | 239/533.12 |
| 4,275,693 | 6/1981 | Leckie | 123/447 |
| 4,308,891 | 1/1982 | Loup | 137/551 |
| 4,354,662 | 10/1982 | Thompson | 251/625.5 |
| 4,375,274 | 3/1983 | Thoma et al. | 239/117 |
| 4,392,612 | 7/1983 | Deckard et al. | 239/88 |
| 4,396,037 | 8/1983 | Wilcox | 137/625.65 |
| 4,409,638 | 10/1983 | Sturman et al. | 361/152 |
| 4,482,094 | 11/1984 | Knape | 239/88 |
| 4,501,290 | 2/1985 | Sturman et al. | 137/495 |
| 4,516,600 | 5/1985 | Sturman et al. | 137/495 |
| 4,518,147 | 5/1985 | Andresen et al. | 251/121 |
| 4,526,519 | 7/1985 | Mowbray et al. | 417/490 |
| 4,541,454 | 9/1985 | Sturman et al. | 137/505.41 |
| 4,558,844 | 12/1985 | Donahue, Jr. | 251/118 |
| 4,610,428 | 9/1986 | Fox | 251/129.16 |
| 4,653,455 | 3/1987 | Eblen et al. | 123/506 |
| 4,658,824 | 4/1987 | Scheibe | 123/472 |
| 4,702,212 | 10/1987 | Best et al. | 123/472 |
| 4,721,253 | 1/1988 | Niguchi eta l. | 239/464 |
| 4,753,416 | 6/1988 | Inagaki et al. | 251/129.15 |
| 4,794,890 | 1/1989 | Richeson, Jr. | 123/90.11 |
| 4,811,221 | 3/1989 | Sturman et al. | 364/420 |
| 4,812,884 | 3/1989 | Mohler | 335/258 |
| 4,813,599 | 3/1989 | Greiner et al. | 239/456 |
| 4,831,989 | 5/1989 | Haines | 123/506 |
| 4,834,337 | 5/1989 | Chorkey | 251/129.18 |
| 4,846,440 | 7/1989 | Carlson et al. | 251/129.17 |
| 4,875,499 | 10/1989 | Fox | 137/82 |
| 4,893,102 | 1/1990 | Bauer | 335/132 |
| 4,893,652 | 1/1990 | Noble et al. | 137/596.17 |
| 4,928,887 | 5/1990 | Miettaux | 239/584 |
| 4,964,571 | 10/1990 | Taue et al. | 239/88 |
| 4,993,637 | 2/1991 | Kanesaka | 239/96 |
| 5,004,577 | 4/1991 | Ward | 264/112 |
| 5,014,031 | 5/1991 | Nusser | 335/230 |
| 5,042,445 | 8/1991 | Peters et al. | 123/446 |
| 5,044,563 | 9/1991 | Mesenich | 239/585 |
| 5,049,971 | 9/1991 | Krumm | 357/55 |
| 5,050,543 | 9/1991 | Kawamura | 123/90.11 |
| 5,065,979 | 11/1991 | Detweiler | 251/129.18 |
| 5,110,087 | 5/1992 | Studtmann et al. | 251/129.16 |
| 5,217,036 | 6/1993 | Maier | 251/129.18 |
| 5,299,776 | 4/1994 | Brinn | 251/129.18 |
| 5,301,921 | 4/1994 | Kumar | 251/129.18 |
| 5,315,050 | 5/1994 | Schumann | 251/129.18 |

MAGNETICALLY ADJUSTABLE VALVE ADAPTED FOR A FUEL INJECTOR

TECHNICAL FIELD

The present invention relates generally to fuel injection systems and, more particularly to a method and apparatus for dynamically adjusting the magnetic circuit of control valves adapted for fuel injectors.

BACKGROUND ART

In conventional fuel injection systems, the fuel injectors may be mechanically, hydraulically, or electrically actuated. In hydraulically-actuated systems, the pumping assembly which periodically causes fuel to be injected into the engine cylinders is hydraulically driven by pressurized actuating fluid which is selectively communicated to the pumping assembly by an electronically-controlled valve. One example of a hydraulically-actuated, electronically-controlled fuel injection system is disclosed in U.S. Pat. No. 5,121,730 to Ausman, et al.

In mechanically-actuated systems, the pumping assembly is mechanically coupled to a cam driven by the engine so that the pumping assembly is actuated in synchronism with the rotation of the cam. The precise timing and duration of injection is determined by an electronically-controlled valve associated with the pumping assembly. Typically, the electronically-controlled valve is a solenoid valve.

In multi-cylinder engines in which such fuel injection systems are incorporated, it is important for optimization of the engine performance and emissions that the fuel Injection characteristics for each engine cylinder are the same. The fuel injection characteristics include when fuel infection begins; the duration of injection, and the quantity of fuel injected.

In the past, uniformity of the fuel injection characteristics from cylinder to cylinder has been accomplished by adjusting the response of the solenoid valve associated with each fuel injector once when the engine is manufactured. Such a solenoid valve includes an armature, a pole member, and a spring which biases the armature away from the pole member. When such a valve is energized, the force of the spring pre-load must be overcome before the armature is urged towards the pole member. The valve response has been adjusted by changing the pre-load of the spring, which can be accomplished by changing the initial compression of the spring with one or more relatively thin inserts or shims.

For example, when a relatively thick shim is used to increase the initial compression of the spring the solenoid valve takes longer to operate since a greater spring force must be overcome. When a relatively thin shim is used to decrease the initial compression of the spring, the solenoid valve operates more quickly since the spring force which must be overcome is less.

The practice of tuning a solenoid valve by adding, removing and/or changing shims is tedious and time consuming. For each fuel injector in the engine, such a procedure may require assembly of the injector, testing of the injector, disassembly of the injector to add or remove a shim, reassembly of the injector, testing of the injector, etc. Because of the time and effort required to disassemble and reassemble the fuel injector to change a shim, the fuel injectors are adjusted until a minimum, but not an optimal, performance threshold is achieved.

The present invention is directed at overcoming one or more of the problems as set forth above.

DISCLOSURE OF THE INVENTION

In one aspect of the present invention a solenoid actuator adapted for use in an electronic control valve for a fuel injector is disclosed. The solenoid actuator comprises an electrically energizable electromagnetic device and a pole member associated with said electrically energizable electromagnetic device. The actuator further includes an armature movable with respect to the pole member. The armature occupies a first position relative to the pole member when the electromagnetic device is not electrically energized and a second position relative to the pole member when the electromagnetic device is electrically energized. The actuator further includes a biasing means for adjusting the magnetic circuit.

In another aspect of the present invention, an electronically controlled fuel injector is disclosed. The fuel injector includes a fuel injector body and a nozzle disposed in the fuel injector body. The injector also includes an injection means for causing fuel to be periodically injected by the nozzle and an electronic control valve disposed in the fuel injector body and operatively coupled to the injection means. The control valve has a first position which causes fuel to be injected by the nozzle and a second position in which fuel is prevented from being injected by the nozzle. The control valve comprises an electrically energizable electromagnetic device and a pole member associated with the electrically energizable electromagnetic device. The control valve also includes an armature movable with respect to the pole member The armature occupies a first position relative to the pole member when the electromagnetic device is not electrically energized and a second position relative to the first pole member when the electromagnetic device is electrically energized. The control valve further includes a biasing means for adjusting the magnetic circuit.

Adjustment of the solenoid actuator in accordance with the invention does not require repeated assembly and disassembly of the actuator, but may be performed after the actuator is assembled without the need to disassemble the actuator.

BEST MODE FOR CARRYING OUT THE INVENTION

Figure 1:
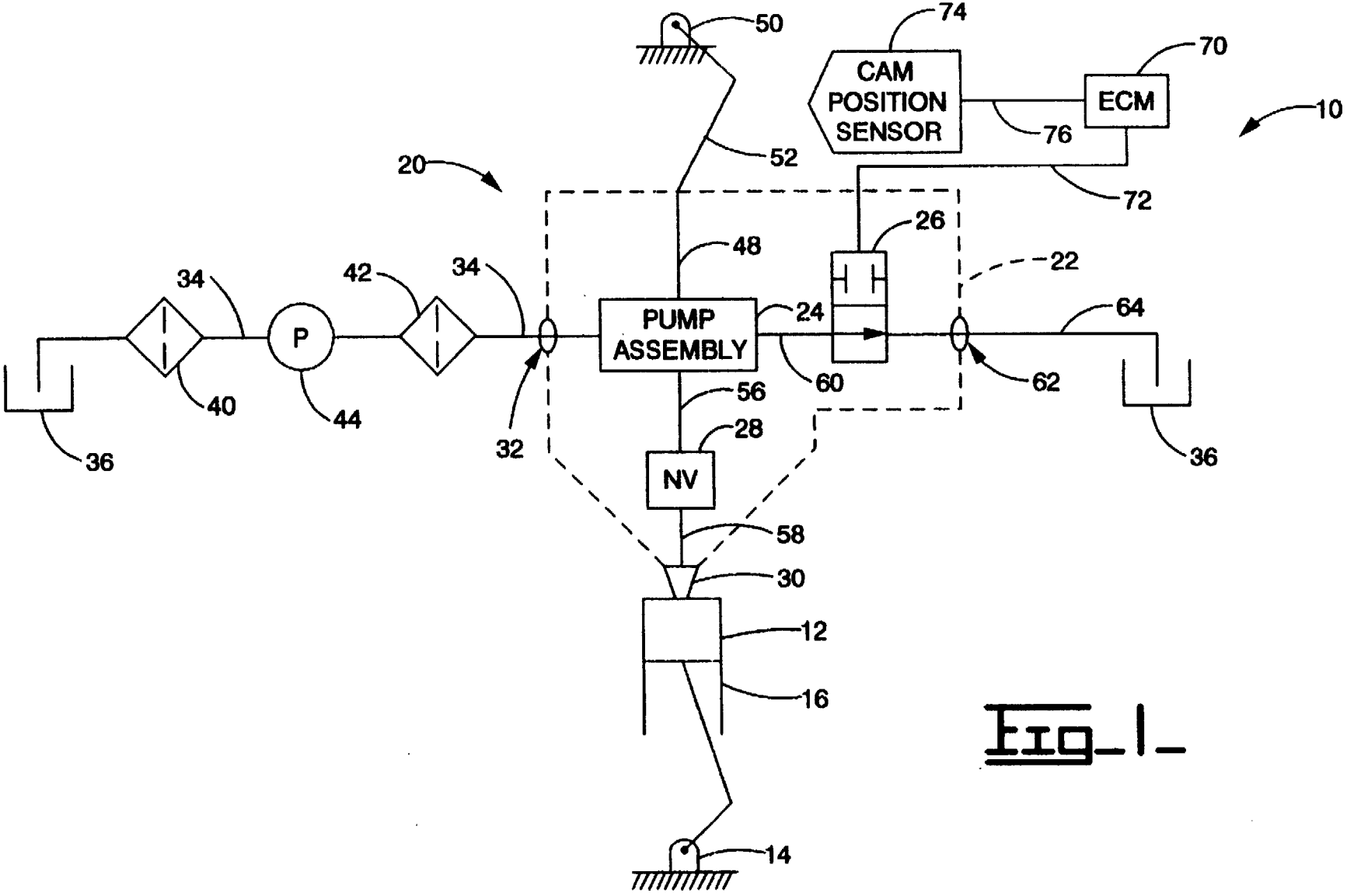
FIG. 1 is a schematic diagram illustrating a mechanically-actuated electronically-controlled unit injector fuel system having a fuel injector with an electronic control valve.

One embodiment of a mechanically-actuated electronically-controlled unit injector ("MEUI") fuel system 10 is illustrated in FIG. 1. The fuel injection system 10 is adapted for a diesel-cycle, direct-injection internal combustion engine having a number of engine pistons 12, one of which is shown attached to an engine crank 14 and disposed for reciprocating movement in an engine cylinder 16.

Fuel is injected into the cylinder 16 by a fuel injector 20 having a fuel injector body schematically designated by dotted lines 22, a pump assembly 24, a control valve 26; a nozzle valve 28, and a nozzle tip 30. Pressurized fuel is supplied to the pump assembly 24 through a fuel inlet 32 fluidly connected to a fuel passageway or line 34, which is in turn fluidly connected to a fuel tank or reservoir 36. A pair of fuel filters 40, 42 are provided in the fuel line 34; and the fuel is pressurized to a relatively low pressure, such as 410 kPa (60 psi) by a transfer pump 44.

The relatively low pressure fuel supplied to the pump assembly 24 via the fuel passageway 34 is periodically pressurized to a relatively high injection pressure, such as 210,000 kPa (30,000 psi), by a plunger 48 which is mechanically connected to an engine cam 50 via a rocker arm 52. The nozzle valve 28 is fluidly connected to the pump assembly 24 via a fuel passageway 56 and is fluidly connected to the nozzle tip 30 via a fuel passageway 58. The nozzle valve 28 operates as a check valve which opens when the fuel provided to it by the pump assembly 24 reaches a relatively high threshold pressure, such as 34,200 kPa (5,000 psi), and closes when the fuel pressure falls below the threshold pressure.

The fuel pressurization provided by the pump assembly 24 is controlled by the control valve 26, which is fluidly connected to the pump assembly 24 via a fuel passageway 60. When the control valve 26 is in its open position, as shown in FIG. 1, fuel may exit the pump assembly 24 via the passageway 60, through a fuel outlet 62 formed in the fuel injector body 22, and through a fuel passageway or line 64 which drains into the fuel reservoir 36, thus preventing the fuel within the pump assembly 24 from being pressurized to the injection pressure by the plunger 48. When the control valve 26 is closed, fuel may not exit the pump assembly 24 via the fuel passageway 60, and thus the fuel may be pressurized by the plunger 48.

The opening and closing of the control valve 26 is controlled by an engine control module ("ECM") 70 connected to it by an electrical line 72. The engine control module 70 is connected to a cam-position sensor 74 which senses the position of the cam 50 and generates a cam-position signal on a line 76 connected to the engine control module 70. In response to the cam-position signal, the engine control module 70 generates electrical power on the line 72 to periodically open and close the control valve 26, which is solenoid-actuated, to cause fuel to be periodically injected into the cylinder 16.

The operation of the fuel injection system 10 is described below in connection with one injection cycle. To begin fuel injection, the control valve 26 is moved from its open position, as shown in FIG. 1, to its closed position, which prevents fuel from exiting the pump assembly 24 via the fuel passageway 60. After the control valve 26 is closed, the rocker arm 52 drives the plunger 48 downwards, which increases the pressure of the fuel within the pump assembly 24 and the pressure of the fuel provided to the nozzle valve 28. When the fuel pressure in the nozzle valve 28 reaches the relatively high threshold pressure, the nozzle valve 28 opens and fuel is injected from the nozzle 30 into the cylinder 16.

When fuel injection is to be ended, the control valve 26 is moved from its closed position to its open position. As a result, pressurized fuel exits the pump assembly 24 through the fuel passageways 60; 64, causing the fuel pressure in the pump assembly 24 and in the nozzle valve 28 to decrease. When the fuel pressure in the nozzle valve 28 falls below the threshold pressure, the nozzle valve 28 closes, thus terminating the injection of fuel into the cylinder 16.

Figure 2:
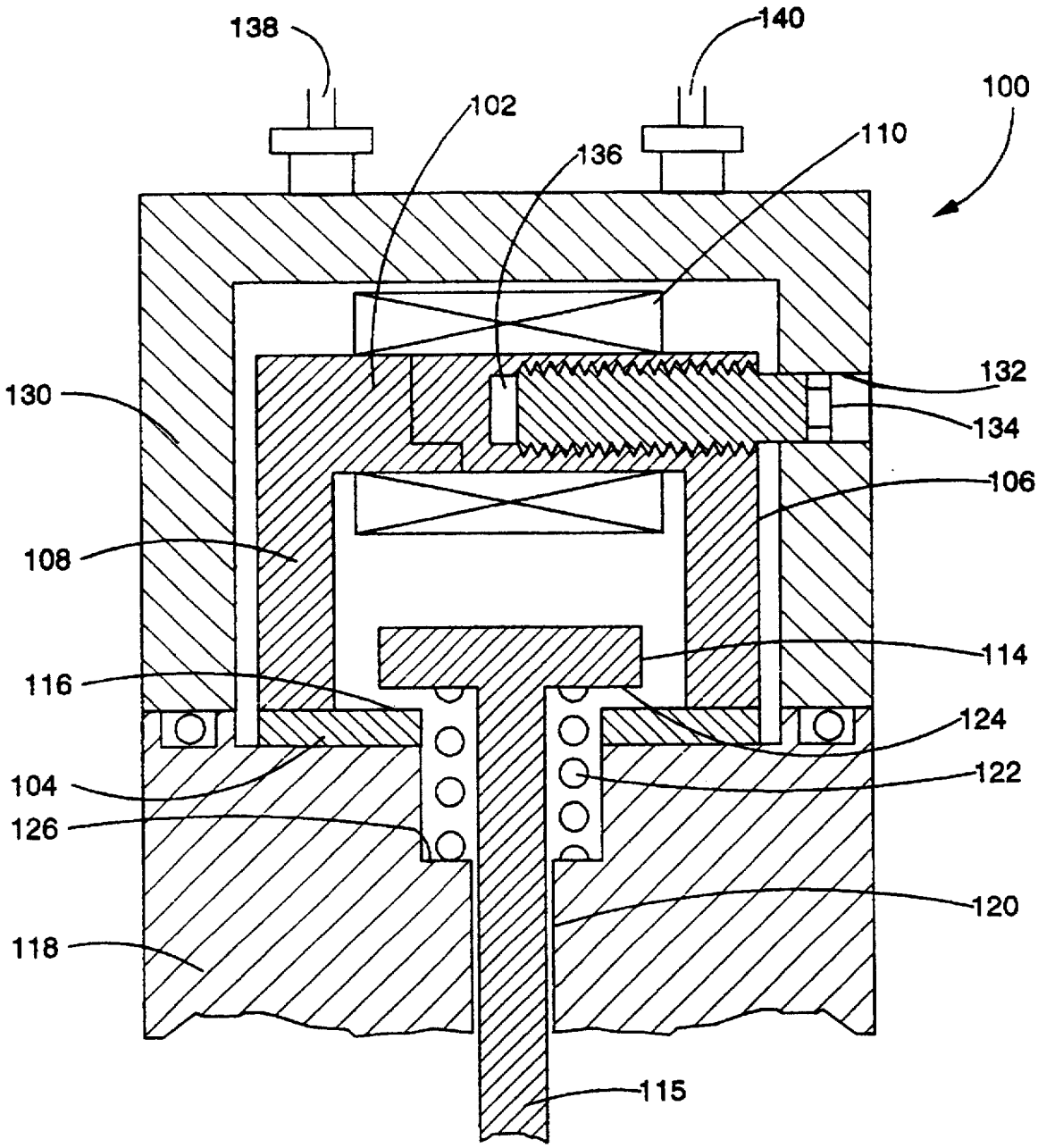
FIG. 2 is a partial cross-sectional view of a solenoid actuator for the electronic control valve shown schematically in FIG. 1.

A cross-section of a solenoid actuator 100 for actuating the control valve 26 is illustrated in FIG. 2. The actuator 100 includes upper and lower pole members 102 and 104, respectively. The upper pole member includes a right hand vertical pole member 106 and a left hand vertical pole member 108 that fit together, preferably with a slip fit. The actuator 100 further includes an electromagnetic device 110, such as an energizable winding or wire coil. The wire coil 110 is formed around a bobbin core. The upper pole member 102 is formed to partially enclose the wire coil 110 and core. A generally flat, cylindrical armature 114 is shown spaced apart from the top face 116 of the lower pole member 104. The armature 114 is supported by a rod or valve stem 115 which may be connected to it by any conventional means, such as a bolt (not shown). A generally cylindrical housing member 118 has a bore 120 through which the valve stem 115 passes. The housing member 118 encloses a portion of the valve stem 115 and a spring 122 disposed between a lower face 124 of the armature 114 and the upper face 126 of the housing member 118 to bias the armature 114 away from the top face 116 of the lower pole member 104. The housing member 118 is made from a non-magnetic material such as stainless steel.

A non-magnetic housing 130 is disposed above the cylindrical housing member 118 and encloses the wire coil 110 and the pole members 102, 104. The housing 130 Is sealed to the cylindrical housing member 11-8 by a standard o-ring configuration. The housing 130 and the right hand vertical pole member 106, as shown in FIG. 2, include a threaded bore 132. An adjustment screw 134 is provided in the bore 132. The adjustment screw 134 is threaded into the vertical pole member 106. The depth of the adjustment screw 134 controls the width of a variable gap 136 which is defined by the end of the adjustment screw 134 and the end of the threaded bore 132.

A pair of electrical contact members 138, 140 which are electrically connected to (not shown) the wire coil 110 are disposed in the upper portion of the housing 130. The electrical contact members 138, 140 facilitate electrical energization of the coil 110 via the line 72 shown in FIG. 1. The pole members 102 and 104 and the armature 114 are preferably formed of silicon iron.

When the solenoid actuator 100 of FIG. 2 is incorporated in the control valve 26, the pole members 102 and 104 and the housing 130 would be stationary with respect to each other, and the armature 114 and the valve stem 115 would reciprocate up and down in the vertical direction. A valve element, such as a poppet, would be connected to the end of the valve stem 115, and the poppet would be movable with respect to a valve seat, so that the control valve 26 would be opened and closed by reciprocation of the stem 115. The structural details of the valve element and valve seat of the control valve 26 are not considered important to the invention.

In operation, the solenoid actuator 100 has two states or positions, a first or actuated position in which the armature 114 is spaced from the top face 116 of the lower pole member 104 by a relatively small distance, and a second or non-actuated position in which the armature 114 is spaced from the top face 116 of the lower pole member 104 by a relatively large distance.

To actuate the solenoid 100, the wire coil 110 is energized by passing electric current through it in a direction to attract the armature 114 towards the lower pole member 104. When the attractive force overcomes the spring pre-load force of the bias spring 122, the armature 114 moves downward towards the top surface 116 of the lower pole member 104, causing the control valve 26 to change positions, for example, from open to closed.

To deactuate the solenoid 100, the electric current previously generated in the wire coil 110 is terminated, and consequently the armature 114 is urged away from the top face 116 by the bias spring 122, thus causing the control valve 26 to change positions, for example, from closed to open.

The provision of the adjustment screw 134 in upper pole member 102 to create the adjustable air gap 136 is advantageous in that it allows adjustment of the magnitude of the attractive magnetic force generated on the armature 114 when the wire coil 110 is energized. When the width of the air gap 136 is increased, the reluctance to the magnetic flux is increased, and consequently the attractive force between the lower pole member 104 and the armature 114 is decreased. Similarly, when the width of the air gap 136 is decreased, the reluctance in the upper pole piece to the magnetic flux is decreased, and the attractive force between the lower pole member 104 and the armature 114 is increased.

It should be recognized that the actuation speed or response time of the actuator 100, and thus the closing (or opening) speed of the valve 26, depends on the magnitude of the force generated by the solenoid actuator 100, which in turn depends upon the reluctance of the pole members 102, 104, which is dependent on the width of the variable air gap 136.

Initially; prior to each fuel injector 20 being installed in an engine; the response of the control valve 26 of the fuel injector 20 is tuned or adjusted by turning the adjustment screw 134 to adjust the reluctance in the pole members 102, 104 and thus the magnetic force generated by the actuator 100. It should be appreciated that the magnetic force is continuously adjustable since the adjustment screw 134 can be turned by any amount. The control valve 26 of each injector 20 to be installed in an engine is tuned so that its response is identical to the control valves 26 of the other fuel injectors 20 to achieve optimal performance of the engine. After each injector 20 is so tuned, its adjustment screw 134 may be locked into place via any conventional means, such as staking, so that it remains locked in the same position throughout the operating life of the engine.

The present invention allows for the dynamic adjustment of the timing of the fuel injection through a magnetic adjustment. By this method the stroke of the control valve 26 is not changed which is a significant advantage in diesel fuel injection valves. Changing the stroke changes the amount of fuel delivered and when it is delivered for each injection cycle. The present invention allows for the adjustment of injection timing independent of fuel quantity delivered.

In diesel fuel injection systems, injection pressures range from 18,000 psi to 30,000 psi. This makes it very difficult to provide external seals which prevent the leakage of fuel into the engine crankcase oil and thereby destroy the lubrication properties of the oil. The present invention eliminates this concern by providing for the adjustment in an area of the injector away from high injection pressure fuel. In the fuel injection actuator shown in FIG. 2, the fuel in the area around the adjustment means 134 is under very low pressure. The fuel pressure inside the cylindrical housing member 118, is vented to the fuel drain. This embodiment allows for the usage of standard sealing techniques, such as o-rings, on the external surfaces of the fuel injector.

Industrial Applicability

Although the fuel injection system 10 is particularly adapted for use in a diesel-cycle direct-injection internal combustion engine, the fuel injection system 10 may be used with any type of diesel engine, spark ignition engine or any other type of engine where it is necessary or desirable to inject fuel into an ignition chamber.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved

I claim:

1. An electronically controlled fuel injector comprising:

a fuel injector body;

a fuel inlet formed in said fuel injector body;

pump means disposed in said fuel injector body and being supplied with fuel from said fuel inlet;

a nozzle valve disposed in said fuel injector body and being provided fuel from said pump means, said nozzle valve occupying an open position when said fuel provided by said pump means is above a threshold fuel pressure and a closed position when said fuel provided by said pump means is below a threshold fuel pressure;

an electronic control valve disposed in said fuel injector body and being fluidly connected to said pump means, said control valve having a first position in which fuel in said pump means may be pressurized to said threshold fuel pressure and a second position which prevents fuel in said pump means from being pressurized to said threshold pressure, said control valve comprising:

an electrically energizable electromagnetic device;

an upper pole member associated with said electrically energizable electromagnetic device and a lower pole member separated therefrom in an axial direction;

an armature movable with respect to said pole members, said armature occupying a first position relative to said pole members when said electromagnetic device is not electrically energized and a second position relative to said pole members when said electromagnetic device is electrically energized;

an adjustment screw for dynamically adjusting the magnetic circuit, said screw being threadably adjustable along an axis which is non-parallel to said axial direction with respect to said upper pole member so as to form an air gap of variable width internal to said upper pole member.

2. A fuel injector as defined in claim 1 wherein the width of said variable air gap adjusts the magnetic reluctance of the pole members.

3. A fuel injector as defined in claim 1 additionally comprising spring means for biasing said armature away from said lower pole member.

4. A fuel injector as defined in claim 2 wherein the movement of the armature between its first and second positions is not affected by adjustment of the magnetic reluctance.

5. A fuel injector as defined in claim 2 wherein the adjustment of the magnetic reluctance adjusts the timing of the fuel delivery independent of the quantity of fuel delivered.

6. A fuel injector as defined in claim 1 wherein the fuel injection pressure is greater than 20,000 psi.

7. A fuel injector as defined in claim 1 wherein said adjustment screw is in a cavity, said cavity being vented to a fuel drain.

8. A fuel injector as defined in claim 2 wherein adjustment of the magnetic reluctance does not require repeated assembly and disassembly of the fuel injector.

9. A fuel injector as defined in claim 2 wherein adjustment of the magnetic reluctance may be performed after the fuel injector is assembled without the need to disassemble the fuel injector.

10. An electronically controlled fuel injector comprising:

a fuel injector body;

a nozzle disposed in said fuel injector body;

injection means for causing fuel to be periodically injected by said nozzle;

an electronic control valve disposed in said fuel injector body and operatively coupled to said injection means, said control valve having a first position which causes fuel to be injected by said nozzle and a second position in which fuel is prevented from being injected by said nozzle, said control valve comprising;

an electrically energizable electromagnetic device;

an upper pole member associated with said electrically energizable electromagnetic device and a lower Pole member separated from said upper pole member;

an armature movable with respect to said pole members, said armature occupying a first position relative to said pole members when said electromagnetic device is not electrically energized and a second position relative to said pole members when said electromagnetic device is electrically energized;

a biasing means for adjusting the magnetic circuit; and spring means for biasing said armature away from said lower pole member.

11. A fuel injector as defined in claim 10 wherein said biasing means comprises:

an adjustment screw, said screw being threadably inserted in said pole member, said screw being movable with respect to said pole member so as to form an air gap of variable width internal to said pole member.

12. A fuel injector as defined in claim 10 wherein said injection means comprises pump means fluidly connected to a nozzle valve.

13. A fuel injector as defined in claim 10 wherein said biasing means is continuously adjustable.

14. A solenoid actuator adapted for use in an electronic control valve for a fuel injector, said solenoid actuator comprising:

an electrically energizable electromagnetic device;

an upper pole member associated with and disposed within said electrically energizable electromagnetic device and a lower pole member separated from said upper pole member by a predetermined distance in an axial direction;

an armature movable with respect to said pole members, said armature occupying a first position relative to said pole members when said electromagnetic device is not electrically energized and a second position relative to said pole members when said electromagnetic device is electrically energized, said armature being engageable with said lower Dole member when said electromagnetic device is energized;

a biasing means for adjusting the magnetic circuit ; and a spring for biasing said armature away from said lower pole member.

15. A solenoid actuator as defined in claim 14 wherein said biasing means includes an adjustment screw, said screw being threadably inserted in said upper pole member along an axis which is non-parallel to said axial direction, said screw being movable with respect to said upper pole member so as to form an air gap of variable width internal to said upper pole member between said screw and said upper pole member.

16. A solenoid actuator as defined in claim 14 wherein said biasing means is continuously adjustable.

* * * * *